United States Patent [19]

Stahlecker et al.

[11] Patent Number: 4,563,871

[45] Date of Patent: Jan. 14, 1986

[54] YARN PIECING METHOD AND APPARATUS

[75] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[73] Assignees: Hans Stahlecker; Fritz Stahlecker, both of Fed. Rep. of Germany

[21] Appl. No.: 619,139

[22] Filed: Jun. 11, 1984

[30] Foreign Application Priority Data

Jun. 11, 1983 [DE] Fed. Rep. of Germany ..... 3321234

[51] Int. Cl.[4] ..... D01H 15/02

[52] U.S. Cl. ..... 57/263; 57/22

[58] Field of Search ..... 57/22, 202, 261, 263, 57/401, 411, 413

[56] References Cited

U.S. PATENT DOCUMENTS

| | | | |
|---|---|---|---|
| 4,202,163 | 5/1980 | Turk et al. | 57/401 |
| 4,327,545 | 5/1982 | Fehrer | 57/401 X |
| 4,367,623 | 1/1983 | Parker et al. | 57/263 |
| 4,392,343 | 7/1983 | Parker et al. | 57/401 |

*Primary Examiner*—Donald Watkins

*Attorney, Agent, or Firm*—Barnes & Thornburg

[57] ABSTRACT

A process and apparatus for piecing a yarn at a spinning unit of an open-end friction spinning machine is disclosed wherein a yarn end, without exposing the wedge-shaped gap, is returned by means of an intake suction means, the suction effect of the suction device affecting the wedge-shaped gap being switched off. Preferably, the rollers forming the wedge-shaped gap are also stopped during the return of the yarn end section for piecing operations.

29 Claims, 13 Drawing Figures

YARN PIECING METHOD AND APPARATUS

BACKGROUND AND SUMMARY OF THE INVENTION

This invention relates to a process and a device for piecing a yarn at a spinning unit of an open-end friction spinning machine. The spinning unit has two rollers that are drivable in the same rotational direction and are arranged next to one another to form a wedge-shaped gap serving as a yarn forming region. A feeding and opening device is provided for the feeding of single fibers to the wedge-shaped gap. A yarn withdrawal device is provided for drawing off the formed yarn in the direction of the extension of the wedge-shaped gap and a selectively connectable suction device is provided for holding the forming yarn in the wedge-shaped gap. For accommodating yarn piecing without exposing the wedge-shaped gap, an already spun yarn end is brought back into the area of the wedge-shaped gap by means of an intake suction device. Subsequently, the previously interrupted feeding of fibers is resumed and the yarn is drawn off again.

Manual yarn piecing at a spinning unit of an open-end friction spinning machine is described in European Published Unexamined Application (EP-OS) No. 344 27, where only one of two rollers is formed as a so-called suction roller. This suction roller has a perforated shell and a suction insert arranged on the inside of the shell. During the piecing of the yarn, the yarn take-up spool is lifted off its operative drive, after which the already spun yarn is taken off and is shortened to a predetermined length which will suffice to return to the yarn forming region. Subsequently, the yarn, while by-passing the withdrawal rollers on the machine which continue to operate in an unchanged manner, is conveyed to a yarn withdrawal tube and drawn into the spinning unit under the effect of the low pressure of the suction device affecting the wedge-shaped gap. In the case of this device, it is provided that by means of the manual operation, the suction slot of the suction device can gradually be closed in a manner that the closing first starts in the area facing the yarn withdrawal tube. This is designed to have the result that the yarn end with the decreasing suction slot is to be drawn further into the spinning unit. As an extension of the wedge-shaped gap, another intake suction device is also provided which is supposed to hold the yarn when the suction slot is completely closed. The yarn end is then supposed to be held in a straight stretched line at a distance from the wedge-shaped gap. After the suction device is turned on again, the yarn end is supposed to place itself in a stretched position in the wedge-shaped gap, the length of the yarn end being dimensioned in such a way that the tip of the yarn end is located in the fiber feeding region. Almost simultaneously with the switching-on of the suction device, the feeding is started, after which the yarn withdrawal is started by placing the take-up spool on its drive roller, after which the pieced yarn is placed in the nip line of withdrawal rollers serving as the withdrawal device. This process does not make it possible to provide yarn piecing points or sections which are of sufficient high quality that they can also be used when the yarn is processed further. On the contrary, the yarn piecing sections must be cleaned out before a further processing of the yarn. One of the reasons is that the returned yarn end during the return is sucked to the running rollers so that the yarn end, even when it is not located in the wedge-shaped gap, receives an increased twist. In addition, the moving sequences for the turning-on and restarting of the individual steps cannot be coordinated in such a way that a yarn piecing section is obtained which, on the one hand, has sufficient stability and, on the other hand, has an appearance that corresponds essentially to the remaining yarn.

The present invention is based on the objective of providing a yarn piecing process and apparatus that is suitable for automation and provides yarn piecings of an improved quality.

These objectives are achieved according to the invention by returning the tip or extreme end section with a length that reaches beyond the yarn forming region and by switching off the suction device affecting the wedge-shaped gap while the yarn end section is being sucked back.

The fact that the yarn end section is returned beyond the yarn forming region provides a longer period of time for carrying out the individual steps of the process during repiecing so that a precise coordination and thus an improvement of the quality of the yarn piecings can be achieved. In addition, the yarn end section is not sucked into the wedge-shaped gap before the actual piecing process, especially also during the return of this yarn end section, so that, on the one hand, it is easier to effect the return and, on the other hand, it is not further twisted excessively.

In an advantageous further development according to certain preferred embodiments of the invention, it is provided that the friction rollers are stopped during the return of the yarn end section. Thus it is avoided that the yarn end is twisted before the actual piecing so that an excessive twisting is avoided.

In a further development according to certain preferred embodiments of the invention, it is provided that the suction device affecting the wedge-shaped gap is switched on after the completion of the return of the yarn end, before the switching-on of the other devices. This ensures that the yarn end section is guided into the wedge-shaped gap to the extent that this is necessary before the actual piecing process, i.e., the feeding of the fibers. It is practical in this case that simultaneously with or shortly after the switching-on of the suction device, the device for the rewithdrawal of the yarn is turned on. This ensures that the yarn end section withdrawal from the intake suction device, with its free end, reaches a precisely defined piecing position without previously being twisted or overtwisted.

In a further development according to certain preferred embodiments of the invention, it is provided that the device for the rewithdrawal of the yarn is initially driven with a withdrawal speed that differs from the operative withdrawal speed (for normal spinning conditions) and is subsequently, preferably continuously, brought to the operative withdrawal speed. This ensures, especially when a decreased withdrawal speed is provided, that longer periods of time are available for the actual piecing process so that slight time deviations do not result in significant faults.

In a further development according to certain preferred embodiments of the invention, it is provided that the switching-on of the feeding of the fibers and the restarting of the friction rollers takes place approximately simultaneously. This makes available a certain quantity of fibers already in the wedge-shaped gap before the yarn end arrives there, so that the yarn end finds fibers in the wedge-shaped gap and can be pieced onto them. It is especially practical that according to certain preferred embodiments of the invention to provide that a quantity of fibers is fed which differs from the operatively fed quantity of fibers during the piecing. It therefore becomes possible to proportion the quantity of fibers in order to avoid thick piecing points while simultaneously ensuring sufficient yarn stability. In this case, the feed quantity of fibers is adapted to the withdrawal speed of the yarn.

In a further development of the invention, it is provided that the yarn end section led back beyond the yarn forming region is guided in such a way that the yarn end is transferred to the wedge-shaped gap in the area of the feeding region of the fibers. It is especially expedient according to preferred embodiments to provide that the yarn end extending in the wedge-shaped gap during the withdrawal is guided to the wedge-shaped gap along a path which partially coincides with the path of the fed fibers. The yarn end section, and especially the tip or end of the yarn end section, will then move along one path with the fibers so that the yarn end section and the fibers are treated and affected identically, advantageously facilitating the twisting process at the piecing connection. In this case, it is expedient that the feeding of the fiber is turned on before the tip or end of the yarn end section reaches the yarn forming region. Thus a certain number of fibers are already led to the wedge-shaped gap, while another quantity is fed together with the free end of the yarn end section. In this case, it is especially advantageous that the end of the yarn end section is opened up in the form of a fiber beard or tuft before it reaches the yarn forming point. An end that was opened in this manner connects very well with the individual fibers.

In a further development of the invention, it is provided that the rewithdrawal of the yarn end section is switched on and the switching-on of the other devices is accomplished by means of a control device containing timing and control elements responsive to the end of the yarn end section passing a signal transmitting means arranged at a defined location. Thus it becomes possible to carry out the individual operating steps at exactly predeterminable times and therefore also in precisely predeterminable mutual relationships.

In a further development of the invention, a device for carrying out the process is created, where a means is provided for taking up the yarn end section from a take-up spool and transferring the yarn end section to the spinning unit, as well as a device for sucking the yarn end section into the spinning unit, and means for the rewithdrawal of the yarn end, the control of the suction device affecting the wedge-shaped gap and the switching-on of the feeding of the fibers.

In a very advantageous further development of the invention, the device for the receiving and transferring of the yarn end section, the device for making the yarn end into a beard or tuft, the device for the rewithdrawal of the yarn end, the device for the control of the suction effect of the suction device affecting the wedge-shaped gap, and the device for switching-on the feeding are arranged in a maintenance cart that can be moved along the open-end friction spinning machine and selectively positioned adjacent respective spinning units to be serviced. This makes it possible that, on the one hand, the whole piecing process takes place mechanically so that errors by the operating personnel can be avoided. In addition, it is achieved that the devices interacting with one another in certain time sequences are arranged in the maintenance cart so that the precise adjustment of these devices with respect to one another will lead to uniform results at all spinning units. Another advantage is that the devices representing increased expenditures in each case only have to be available once.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
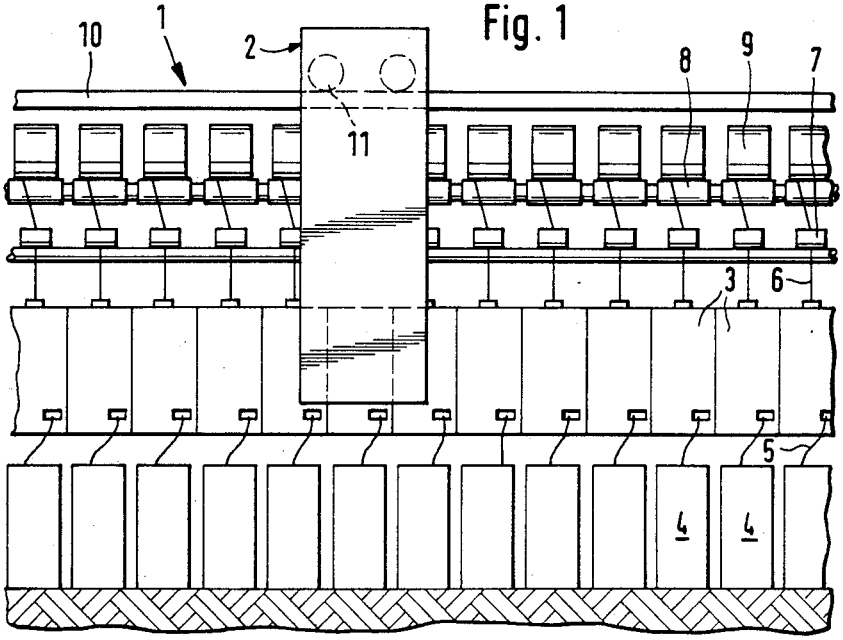
FIG. 1 is a partial schematic front view of an open-end friction spinning machine having a mobile maintenance unit, constructed in accordance with preferred embodiments of the present invention.
Figure 2:
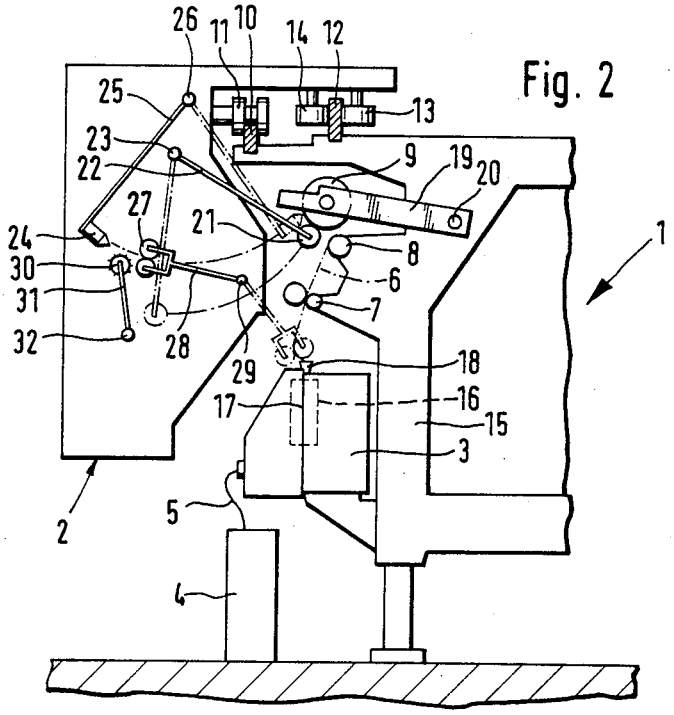
FIG. 2 is a diagrammatical sectional view through the open-end friction spinning machine of FIG. 1 in the area of a spinning unit and of the maintenance unit carrying out a piecing process.

The open-end friction spinning machine 1 shown in FIGS. 1 and 2 includes a plurality of spinning units 3 arranged in a row next to one another, preferably on both sides of the machine. The spinning units 3 each receive a sliver 5 from a can 4, said sliver 5 being spun into a yarn 6 which is drawn off by means of a pair of withdrawal rollers 7 and is wound on a take-up spool 9 resting on and being driven by a driving axle 8. Rails 10 and 12 are arranged along the open-end friction spinning machine 1 for supporting a mobile servicing or maintenance cart or unit 2 which can be driven by means of running wheels 11, 13 and 14 in the longitudinal direction of the open-end friction spinning machine 1 or around the machine (along both sides).

The individual spinning units 3 are arranged at a machine frame 15. They each contain two friction rollers 16, 16' (FIGS. 3 and 4) which are arranged in parallel next to one another and form a wedge-shaped gap 17 serving as a yarn forming region. The yarn 6 spun in the wedge-shaped gap 17 is drawn off via a yarn withdrawal tube 18 in the longitudinal direction of the wedge-shaped gap 17 by means of the pair of withdrawal rollers 7 and is fed to the take-up spool 9 carried by a spool frame 19 which can be swivelled around a shaft 20 mounted at the machine frame 15 in such a way that the take-up spool 9 can be selectively lifted off the driving roller 8.

At least one of the two rollers 16, 16' (FIGS. 3 and 4) of the respective spinning units 3 is developed as a suction roller, especially the roller 16 turning into the wedge-shaped gap 17. This roller 16 has a perforated shell, on the inside of which a suction insert 37 is arranged which aims at or is directed in the area of the wedge-shaped gap 17 by means of a suction slot 38. The section roller 16' which is only schematically represented in FIG. 3 may, in a corresponding manner, also be formed as a suction roller. However, roller 16' may also have a closed shell surface which may possible have a covering to accommodate air flow thereby. Other developments of the rollers 16, 16' are also contemplated such as rollers with closed profiled surfaces, where then a negative pressure is generated in the area of the wedge-shaped gap 17 by means of a suction device that is opposite the wedge shaped gap 17 serving as a yarn forming region.

The suction insert 37 is connected to a negative-pressure line 41 via a connecting piece 39 and a solenoid valve 40. An operating switch 42 is assigned to the solenoid valve 40, said operating switch 42 being accessible from the front side of the open-end friction spinning machine 1.

The two rollers 16, 16' are driven in the same rotational direction of the Arrows A and B by means of a tangential belt 43 running in longitudinal direction of the machine, said belt 43 driving all rollers 16 and 16' of the spinning units 3 of one side of the machine. The tangential belt 43 is under the effect of a tension roller 44 held by a holding means in the area of the rollers 16, 16' which holding means 45 is maintained under tension in the direction toward the rollers 16, 16' by means of a leaf spring 46. When the holding means 45 is pressed back against the leaf spring 46, the tension roller 44 can be moved away from the area of the rollers 16, 16', in which case the tangential belt 43 directed by the tension roller 44 also lifts itself off the rollers 16, 16' and interrupts the drive.

The rollers 16, 16' are preferably mounted on tube-shaped suction inserts 37 by means of roller bearings and at their shell surfaces may be driven directly by the tangential belt 43. Rollers 16, 16' are also arranged in a housing formed by two partial housings 33 and 34, in which case the partial housing 33 is mounted at the machine frame 15 and carries the suction inserts 37.

The housing part 33 is lid-shaped and covers the area of the wedge-shaped gap 17. This part 33 of the housing also contains a part 35 of a fiber feeding channel that is continued with a part 47 in a housing 50 of a feeding and opening device, the mouth 36 of said fiber feeding channel being located in the area of the wedge-shaped gap 17.

Figure 3:
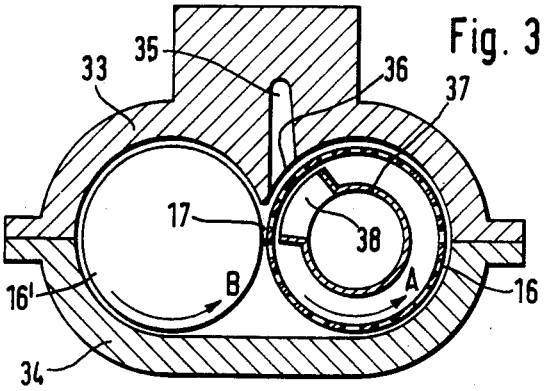
FIG. 3 is an enlarged partial sectional view through a spinning unit in the area of two friction rollers forming a wedge-shaped gap that serves as the yarn forming region.

As shown in FIG. 3, mouth 36 is arranged so that it is closely next to the wedge-shaped gap 17 opposite the shell surface of the roller 16 turning into the wedge-shaped gap 17. The housing 50 of the feeding and opening device has a feeding roller 48 and an opening roller 49 which, in their principal design, are known in the case of open-end rotor spinning machines. The lid-shaped component 33 can be swivelled around an axis 54 of the housing 50 so that the wedge-shaped gap 17 can be exposed in the case of required maintenance. The feeding roller 48 and the opening roller 49, in a manner that is not shown in detail, are connected to central drives of the open-end friction spinning machine 1. For example, the feeding roller 48, via a standing shaft drive, may be connected to a longitudinal shaft running in the longitudinal direction of the machine, and the opening roller 49 may be connected via a tangential belt running in longitudinal direction of the machine. The shaft 51 of the feeding roller 48 is extended toward the outside and is provided with a conical driving wheel 52. The lid-shaped part 33 of the housing has a recess 53 through which the shaft 51 is led.

The spun yarn is withdrawn via a yarn withdrawal tube 18 and guided to the pair of withdrawal rollers 7. The yarn withdrawal tube 18 widens toward the outside in a funnel-shaped manner.

Figure 5:
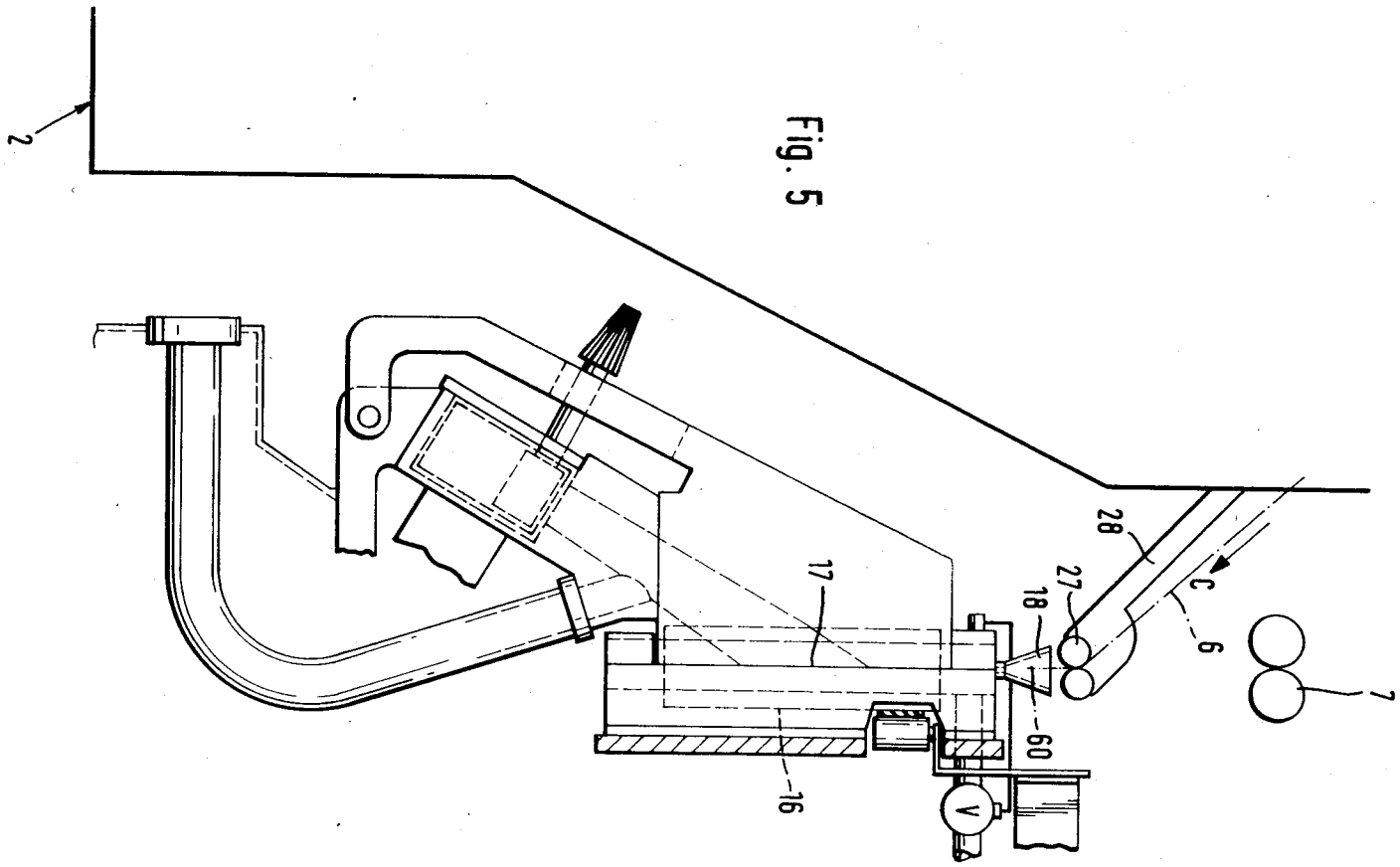
FIG. 5 is a view similar to FIG. 4 showing the machine features during the first phase with the maintenance unit in position before an actual piecing action.

The mobile servicing unit or cart 2 contains the devices shown in FIG. 2 for receiving a yarn end from the take-up spool 9 and other devices shown in connection with FIGS. 5 to 9 for carrying out a piecing process. The servicing unit 2 is provided with a lifting roller 21 which can be driven in both rotational directions and which is arranged on an arm 22 that can be swivelled around an axis 23, so that by means of said lifting roller 21, the take-up spool 9, with its spool holder 19, is lifted off the drive roller 8. Subsequently, a suction nozzle 24 is moved to adjacent the take-up spool 9, said suction nozzle 24 being arranged on a lever 25 that can be swivelled around an axis 27 and serving to draw in the end section of the yarn by suction. With the simultaneous drive of the lifting roller 21 in the take-off direction, the suction nozzle 24 will then be swivelled back, taking along the end section of the yarn. Subsequently, a pair of pinch rollers 27 is applied to the end section of the yarn stretched between the lifting roller 21 and the suction nozzle 24, said pair of pinch rollers 27 being able to be moved apart, and being able to be driven in both rotational directions. The pair of pinch rollers 27 is arranged on a lever 28 that can be swivelled around an axis 29. The yarn end section extending between the suction nozzle 24 and the pinch rollers 27 (FIG. 2), is separated by means of a friction tool 30 developed as a separating disk and is opened up into a beard or tuft of fibers. The friction tool 30 is arranged on a lever 31 which can be swivelled around a shaft 32. By means of a swivelling of the pair of pinch rollers 27, the yarn end section 6, with its fiber-beard type end 60 is applied to the yarn withdrawal 18 (FIG. 5).

Figure 6:
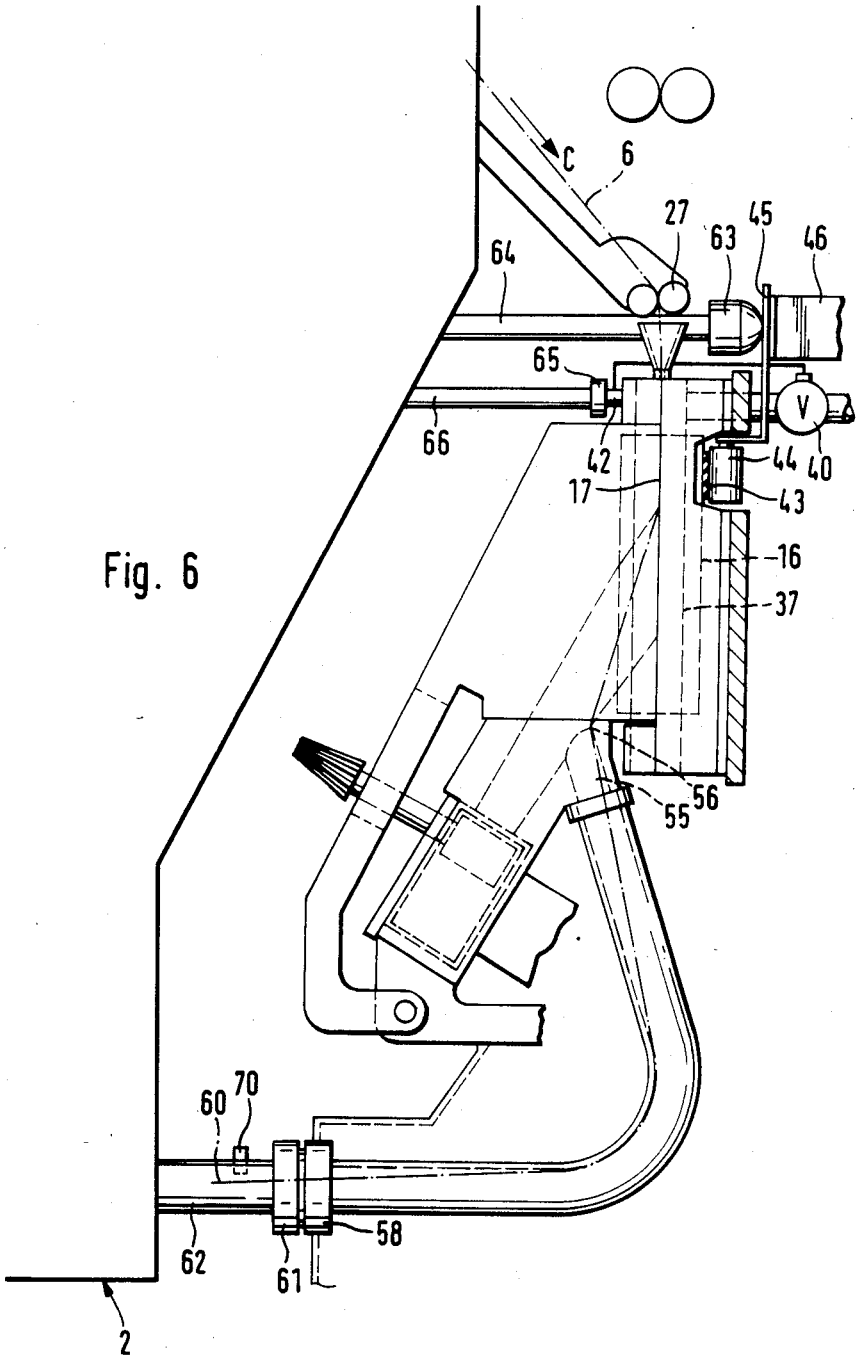
FIG. 6 is a view similar to FIG. 5 illustrating the next phase of the piecing process during the return of a yarn end section into the spinning unit.

After the yarn end section 6 is applied to the yarn withdrawal tube 18, the suction effect of the suction insert or inserts 37 is interrupted. For this purpose, an operating rod 66 with an operating button 65 is adjustably moved to the switch 42 of the solenoid valve 40 by the servicing unit 2 (FIG. 6). The servicing unit 2 also applies a movable operating button 63 to the holding means 45 by means of a rod 64, said operating button 63 pressing back the holding means 45 with the tension roller 44 against the leaf spring 46 so that the tangential belt 43 detaches itself from the rollers 16, 16' so that their drive is interrupted.

Figure 4:
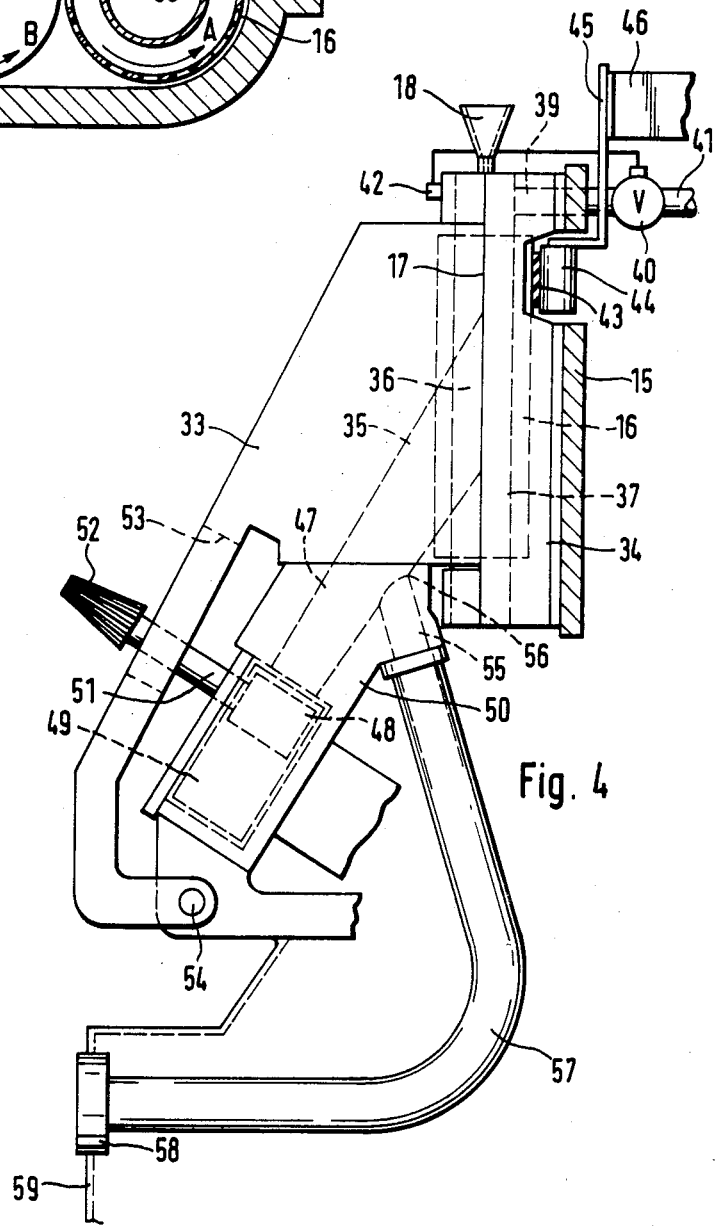
FIG. 4 is an enlarged part-sectional schematic view of an individual spinning unit after a yarn breakage.

A suction nozzle 55 is arranged in the area of the part 47 of the fiber feeding duct located in the housing 50, said suction nozzle 55 being led to a connection 58 located on the front side of the machine casing 59 via a negative pressure pipe 57 (FIG. 4). The servicing unit 2 (FIG. 6) is provided with a suction connection 62, which by means of a connecting piece 61 can be applied to the connection 58 which preferably closes itself when the connecting piece 61 is withdrawn. The suction pipe 62 is connected to a negative pressure source of the servicing unit 2 that is not shown.

Figure 7:
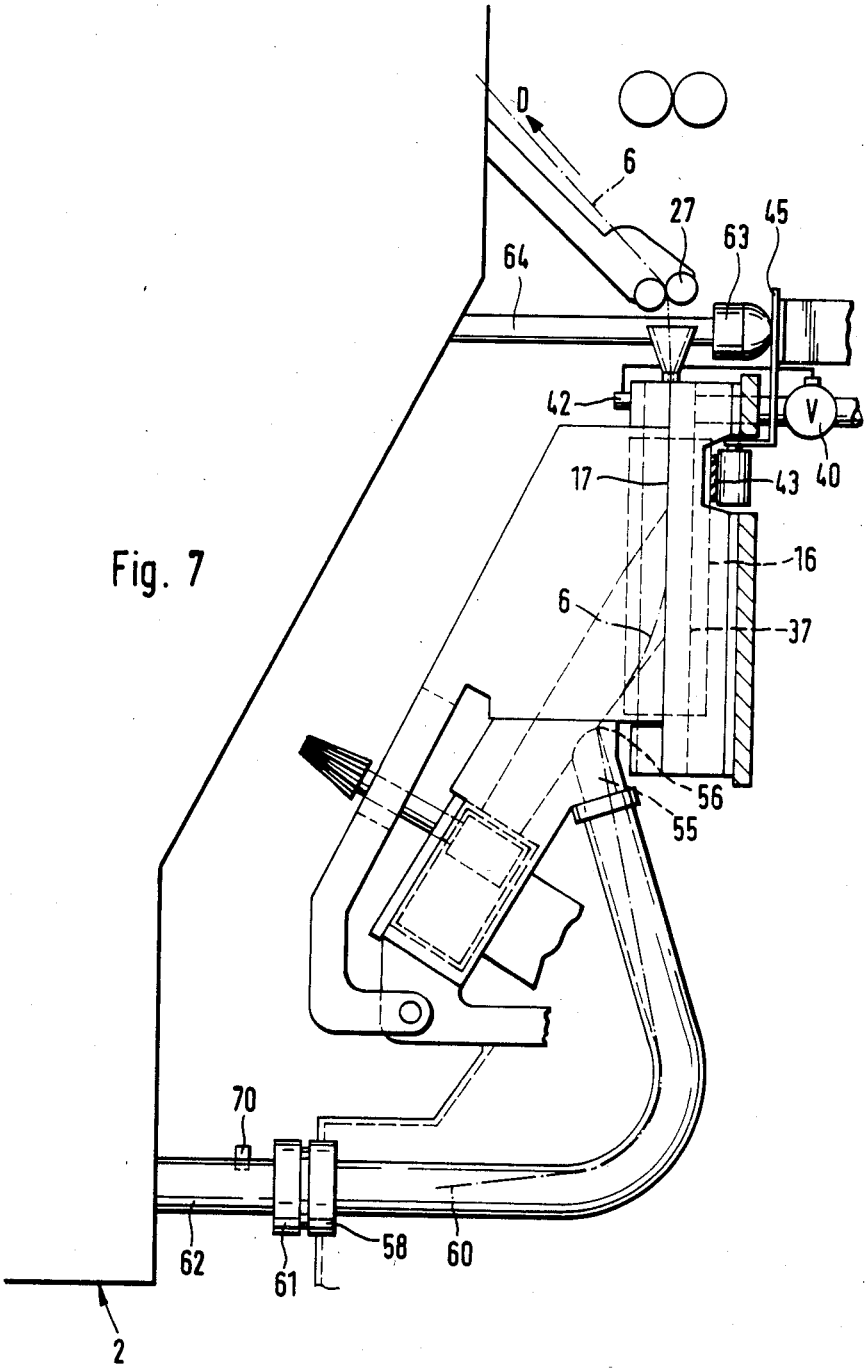
FIG. 7 is a view similar to FIG. 5, illustrating the machine features during the start of the actual piecing process.

After the drive of the rollers 16, 16' is interrupted, the suction effect in the area of the wedge-shaped gap 17 is cancelled, and the intake suction nozzle 55 is connected to a low-pressure source (FIG. 6), the pair of pinch rollers 27 is driven against the withdrawal direction so that the yarn end 6 is introduced into the spinning unit 3 in the direction of the Arrow C. The intake suction nozzle 55 will then take in the yarn end section 6 which, via the suction pipe 57, will arrive in the area of the suction pipe 62 of the service cart 2. A signal transmitter 70 is arranged in the suction pipe 62, said signal transmitter 70 detecting the arriving end 60 of the yarn end section 6 and thus sending a signal ending the return of the yarn end 6. Subsequently, the actual piecing process is started by again switching on the suction effect in the area of the wedge-shaped gap 17 by releasing the switch 42 after which the withdrawal of the yarn end section 6 is started by switching-on the pair of pinch rollers 27 in the withdrawal direction D (FIG. 7). The yarn end section 6 is then sucked into the wedge-shaped gap 17, being held under tension by the intake suction nozzle 55 and guided over an edge 56. The signal transmitter 70 here also detects the passing end 60 of the yarn end section 6 and transmits a corresponding signal to the control of the servicing unit 2 which is provided with corresponding time and control elements in order to carry out a controlled piecing process with respect to time.

Figure 8:
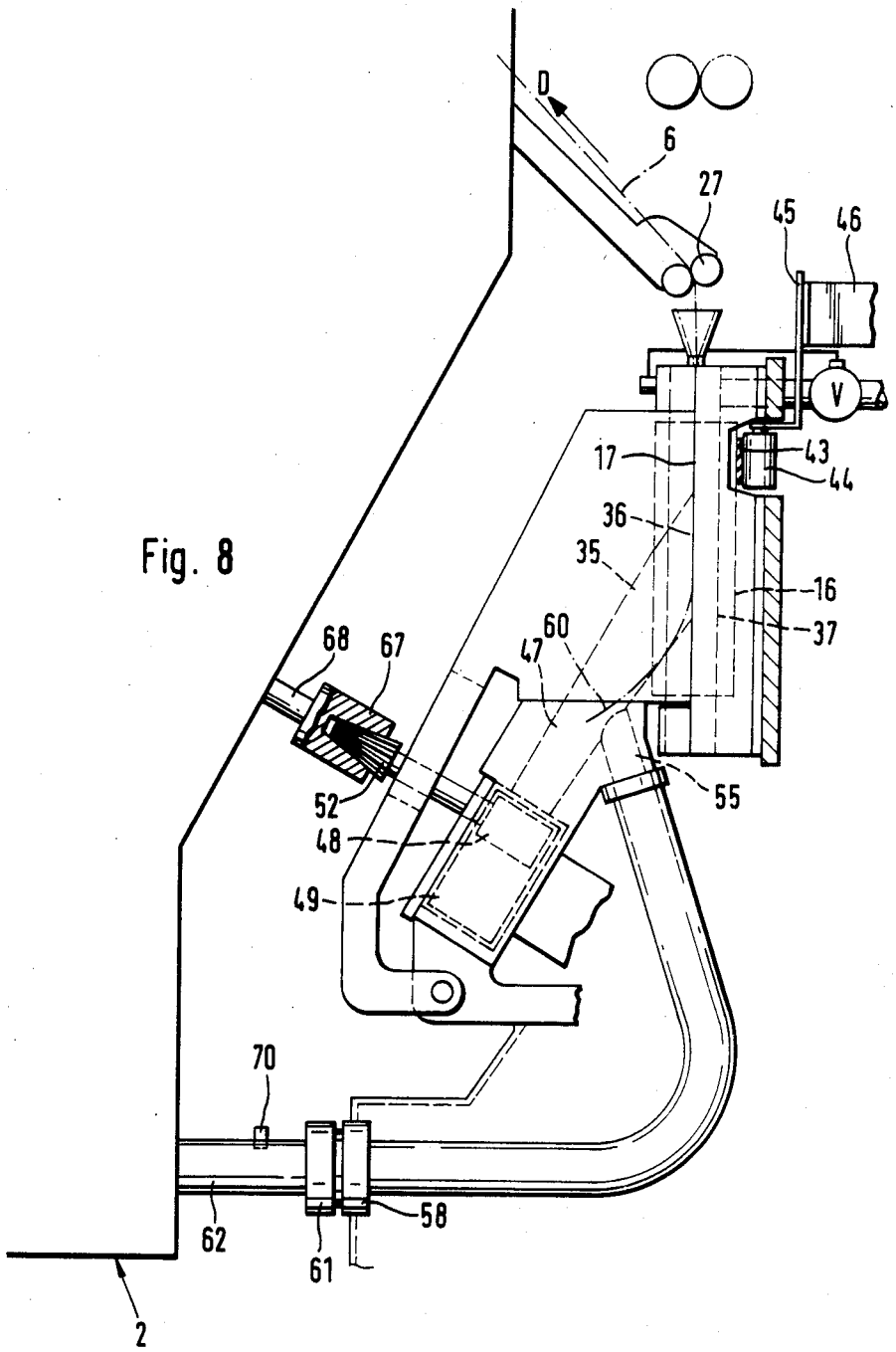
FIG. 8 is a view similar to FIG. 5, illustrating the machine features during the next phase of the piecing process at the start of the fiber feeding process.
Figure 9:
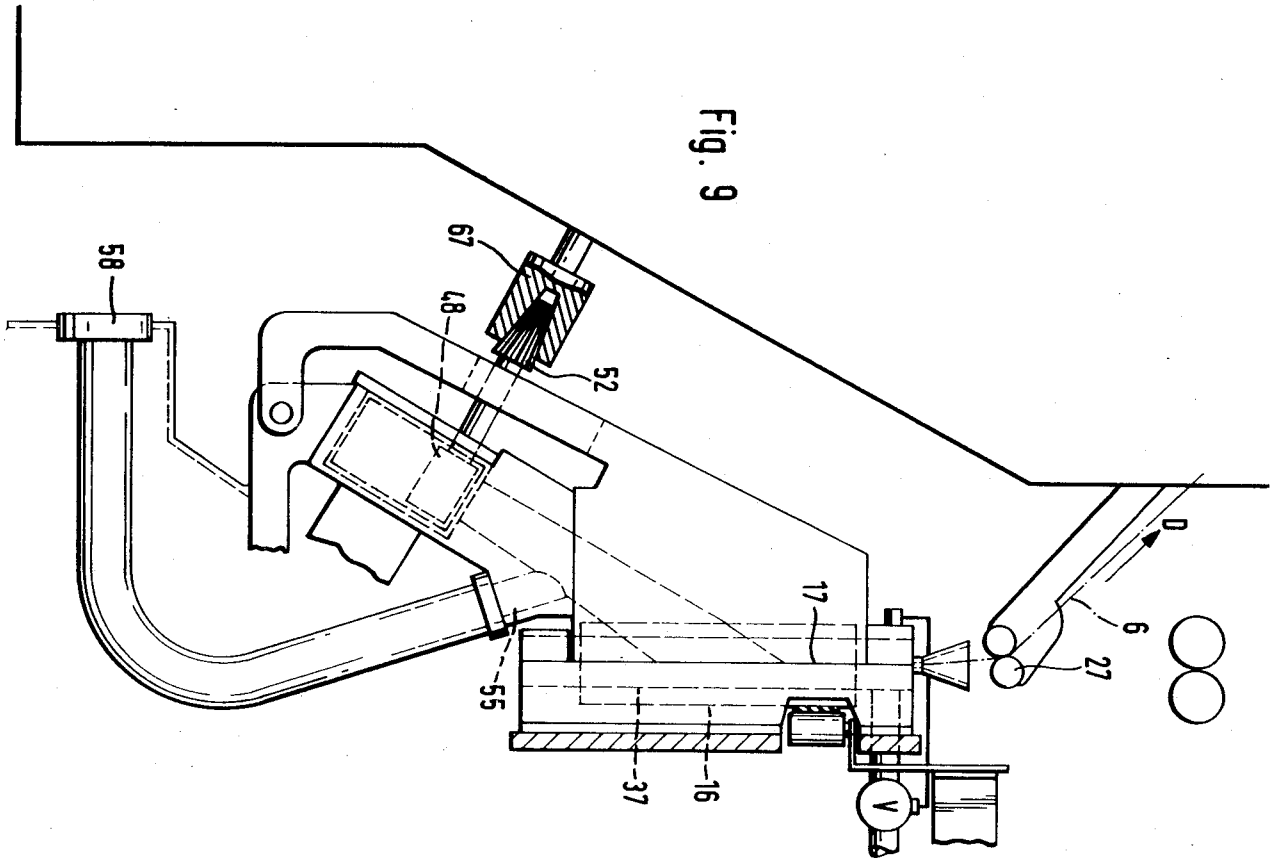
FIG. 9 is a view similar to FIG. 8, illustrating the machine features after the completed piecing process.

The control device provides that an accessory drive shaft 68 with a driving head 67 is applied to the conical toothed wheel 52 of the feeding roller 48, switching on the fiber feeding device (FIG. 8). The fiber feeding had been interrupted when a breakage of the yarn occurred. For example, for this purpose, a yarn monitor can be arranged in the area between the yarn withdrawal tube 18 and the withdrawal rollers 7 which, when the yarn breaks, opens a coupling arranged in the drive of the feeding roller 48 and interrupts the drive of the feeding roller 48. Approximately simultaneously with the starting of the fiber feeding, the drive of the rollers 16, 16' is switched on again by pulling back the rod 64 with the operating button 43, so that the tangential belt 43 is again pressed against the rollers 16, 16' and drives these rollers 16, 16' (FIG. 8).

The switching-on of the feeding and the switching-on of the drives of the rollers 16, 16', as a function of the signal of the signal transmitter 70, is controlled with respect to time in such a way that a feeding takes place before the end 60 of the yarn end section 6 has reached the area of the mouth 36, i.e., has arrived in the wedge-shaped gap 17. At that time, fibers are already present in the wedge-shaped gap 17 to which the end 60 of the yarn end section 6 can be pieced. If necessary, a previous feeding of the fibers takes place, after which the fiber feeding will then again be interrupted for a short time. However, the fiber feeding will be switched back on shortly before the yarn end section 6 with its end 60 reaches the area of mouth 36 so that the end 60 arrives in the wedge-shaped gap 17 together with the single fibers. During this process, it is advantageous to change the yarn withdrawal speed in comparison to the operative normal spinning withdrawal speed, and especially to reduce it, while in addition the quantity of the fed fibers is also reduced as compared to the normal spinning operative quantity.

Figure 10:
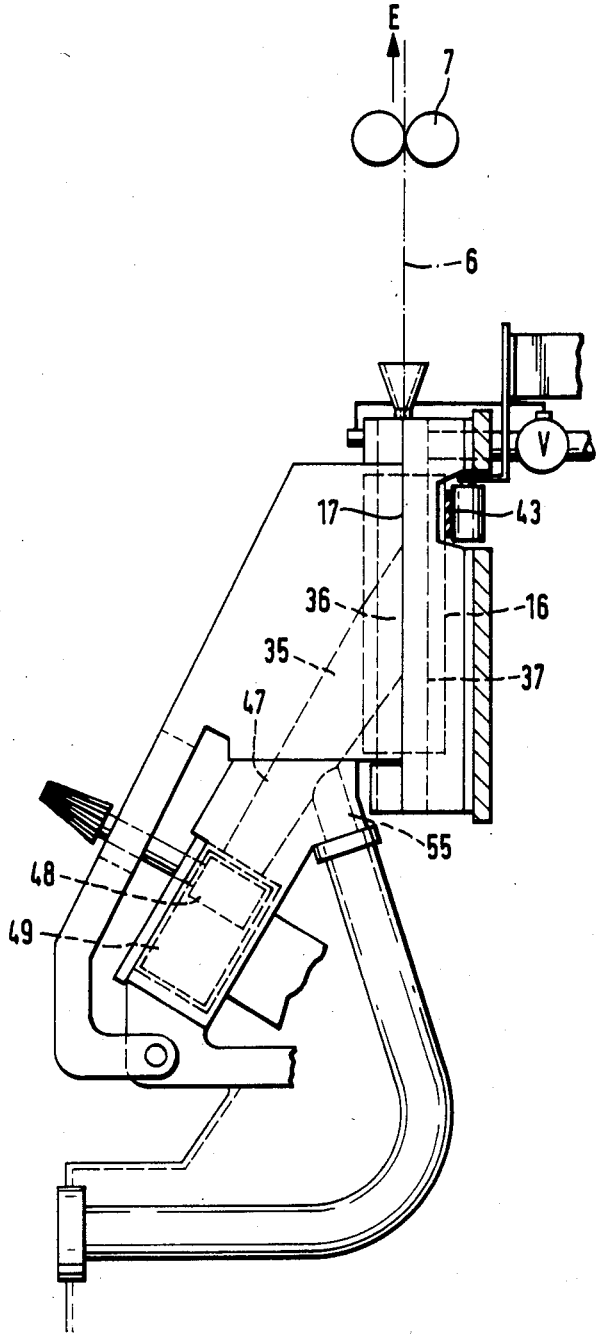
FIG. 10 is a schematic part-sectional view illustrating the spinning unit after the completed piecing process and after the completed transfer of the yarn to the spinning unit.

When the feeding is switched on (FIG. 9), the suction effect of the intake suction nozzle 55 is interrupted by moving back the suction pipe 62 of the servicing unit 2. The yarn end section 6 will now be pieced and drawn off by the pair of pinch rollers 27. In this case, the fiber feeding is increased to the normal spinning operative quantity, while in the same manner, the withdrawal speed of the yarn 6 is brought to the operative normal spinning speed. Then the pieced yarn end section 6 is drawn off in the direction of the Arrow E under normal spinning operational conditions (FIG. 10). In this case, a yarn monitor located between the yarn withdrawal tube 18 and the pair of withdrawal rollers 7 is moved to its operational position so that the operative drive of the feeding roller 48 resumes operation and the accessory drive shaft 68 can be removed.

Figure 12:
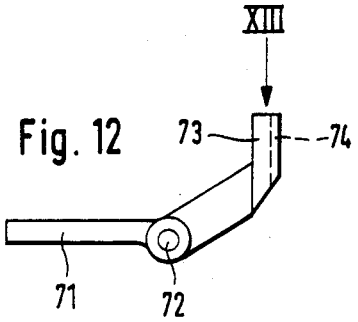
FIGS. 11 to 13 show a slightly modified spinning unit where the return of the yarn end is facilitated further.
Figure 13:
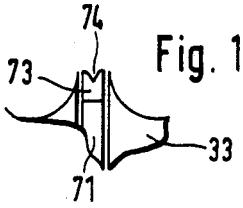
Figure 11:
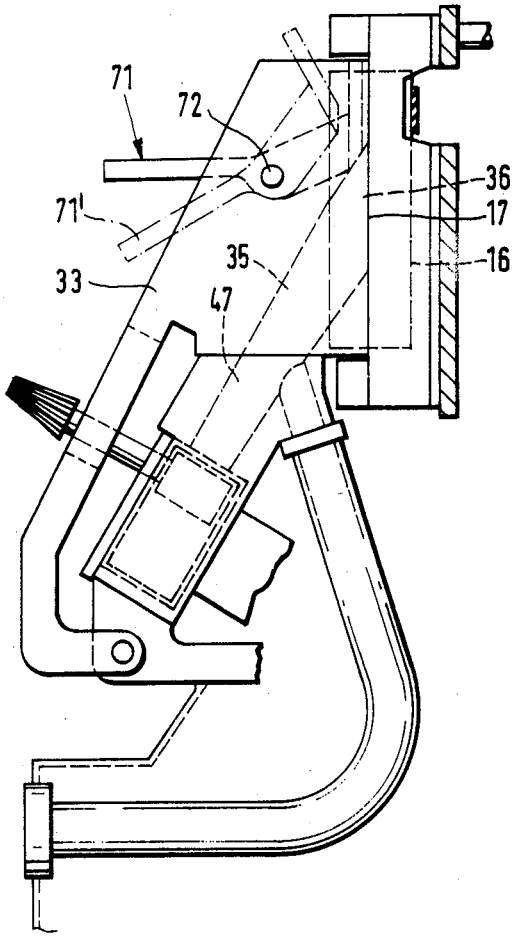

The spinning unit shown in FIGS. 11 to 13 corresponds to the spinning unit shown in FIG. 3 to 10 in its basic construction, but has no yarn withdrawal tube. The component 33 has an insert 73 forming the covering of the wedge-shaped gap 17 existing after the mouth 36 of the part 35 of the fiber feeding channel. This insert 73 can be swivelled around an axis 72 extending transversely to the wedge-shaped gap 17 and is provided with an operating lever 71 protruding from the component 33. The insert 73, which also forms a part of the wall of the channel connected to the mouth 36 and which may be held in the initial position by means of a spring that is not shown can be swivelled into the dash-dotted position via the operating lever 71 so that the area of the mouth 36 becomes accessible from the direction of the yarn withdrawal side, facilitating the intake by suction of a yarn end. The swivelling of the insert 73 takes place by means of an operating mechanism of the servicing unit 2. The insert 73 has a guide groove 74 extending in longitudinal direction of the wedge-shaped gap 17, the returned yarn end being taken hold of by said guide groove 74 and being returned into the proximity of the shell surfaces of the rollers 16. Since the yarn end is first returned in such a way that it does not touch the shell surfaces of the rollers 16, a stoppage of the rollers 16 during the return of the yarn end is not required.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A yarn piecing process for piecing a spun yarn end with fibers in an open-end friction spinning machine of the type having:

two friction rollers rotatably drivable in the same direction and disposed adjacent one another to form a yarn forming wedge-shaped gap therebetween;

fiber supplying means for supplying individual fibers to the wedge shaped gap, yarn holding suction means for applying suction forces to hold the spinning yarn in the wedge-shaped gap during normal spinning operations; and yarn withdrawing means for withdrawing yarn from the wedge-shaped gap, said process comprising piecing the yarn end without exposing the wedge-shaped gap, including:

(i) returning the spun yarn end to beyond the yarn forming region of the wedge-shaped gap utilizing yarn return suction means, and (ii) subsequently switching on the fiber supplying means and the yarn withdrawing means to facilitate piecing of the yarn end with fibers supplied to the wedge shaped gap, (iii) wherein said yarn holding suction means is switched off during the return of the yarn end.

2. A process according to claim 1, comprising stopping the rotation of the friction rollers during returning of the yarn end.

3. A process according to claim 1, comprising switching on the suction device means after said returning of the yarn end and before the switching on of the fiber supplying means and the yarn withdrawing means.

4. A process according to claim 3, wherein the suction device means is operated with a decreased suction effect for initiation of piecing as compared to the suction effect during normal spinning operations.

5. A process according to claim 3, wherein the yarn withdrawing means is switched on simultaneously with or shortly after the suction device means is switched on for piecing operations.

6. A process according to claim 3, wherein for piecing operations, the yarn withdrawing means is intially operated at a withdrawal speed different than its normal spinning withdrawal speed and is later operated at the normal spinning withdrawal speed.

7. A process according to claim 1, wherein the yarn return suction means is operated with reduced suction effect when the yarn holding suction means is switched on.

8. A process according to claim 1, wherein the withdrawal speed of the yarn is reduced or interrupted for a short time after the yarn holding suction means is switched to reduced suction effect.

9. A process according to claim 2, wherein the friction rollers are again started rotating and the fiber supply means is switched on approximately simulataneously.

10. A process according to claim 1, wherein said fiber supplying means is controlled to supply a different quantity of fibers for piecing operations as compared to normal spinning operations.

11. A process according to claim 10, wherein the quantity of fibers fed during peicing operations is reduced as compared to the quantity fed during normal spinning operations.

12. A process according to claim 10, wherein the quantity of fibers fed is adapted to the withdrawal speed of the yarn.

13. A process according to claim 1, wherein said yarn end section returned beyond the yarn forming region is guided for piecing operations such that its free end is transferred to the wedge-shaped gap at the fiber feeding position where fibers are supplied to the wedge-shaped gap by the fiber supplying means.

14. A process according to claim 13, wherein the free end of the yarn end is guided to the wedge shaped gap for piecing operations along a path that coincides at least partially with the path of fibers supplied by the fiber supplying means.

15. A process according to claim 1, wherein the fiber supplying means is switched on before the free end of the yarn end reaches the yarn forming region of the wedge shaped gap during rewithdrawal of the yarn end section.

16. A process according to claim 1, wherein the free end of the yarn end is opened in a fiber beard or tuft before it reaches the yarn forming region of the wedge shaped gap.

17. A process according to claim 1, wherein the rewithdrawal of the yarn end is first switched on, subsequently the passing of the free end of the yarn end section is detected by a detector which sends a signal to a control device having timing and control elements for controlling the switching on of the other devices.

18. Apparatus for spinning yarn in an open-end friction spinning machine comprising:

two friction rollers rotatably drivable in the same direction and disposed adjacent one another to form a yarn forming wedge shaped gap therebetween, fiber supplying means for supplying individual fibers to the wedge-shaped gap, yarn holding suction means for applying suction forces to hold the spinning yarn in the wedge-shaped gap during normal spinning operations, yarn withdrawing means for withdrawing yarn from the wedge shaped-gap, and piecing means for piecing yarn end with fibers being spun without exposing the wedge-shaped gap, including:

(i) yarn return suction means for returning the yarn end to beyond the yarn forming region of the wedge-shaped gap, (ii) yarn holding suction interrupt means for interrupting the application of suction forces by the yarn holding suction means during said returning of the yarn end, and (iii) control means for subsequently switching on the fiber supplying means and the yarn withdrawing means to facilitate piecing of the yarn end with fibers supplied to the wedge-shaped gap.

19. Apparatus according to claim 18, further comprising yarn transfer means for receiving the yarn end from a yarn take-up spool and transferring said yarn end section to the spinning unit having the friction rollers for the piecing operation.

20. Apparatus according to claim 19, further comprising roller drive interrupting means for interrupting the drive of the friction rollers preliminary to piecing operations.

21. Apparatus according to claim 19, further comprising tufting means for working the free end of the yarn into a fiber beard tuft before piecing operations.

22. Apparatus according to claim 18, wherein said yarn return suction means includes an intake suction nozzle for the intake of the yarn end which opens to a fiber feeding channel of the fiber supplying means.

23. Apparatus according to claim 19, wherein a mobile servicing unit is provided which can be selectively positioned for servicing operations adjacent individual spinning units of a spinning machine with plural spinning units, said servicing unit accomodating the yarn transfer means, tufting means, suction control means, means for rewithdrawing the yarn during piecing operations, and control means for switching on the fiber supplying means.

24. Apparatus according to claim 23, wherein the servicing unit is provided with a suction connection which is selectively engageable to apply suction flow at the yarn return suction means.

25. Apparatus according to claim 23, wherein the servicing unit is provided with a yarn end detector in the area of the suction connection for detecting the return of the yarn end for generating a yarn end section signal, said signal serving to initiate a controller for carrying out the piecing operations.

26. Apparatus according to claim 23, wherein said servicing unit includes auxiliary drive means for selectively driving feeding and opening means of the fiber supplying means of a spinning unit.

27. Apparatus according to claim 23, wherein said servicing unit has an operating element selectively operable for controlling the roller drive interrupting means.

28. Apparatus to claim 23, wherein said servicing unit includes movable operating means for selectively controlling valve means to control the yarn holding suction interrupt means.

29. Apparatus according to claim 19, wherein the wedge-shaped gap is covered by a component containing a feeding opening of the fiber supplying means, said component including an insert located upstream of the feeding opening in the yarn withdrawal direction, said insert forming part of the covering for the wedge-shaped opening and being pivotably mounted for movement to a position where the feeding opening becomes accessible.

* * * * *